US006492954B2

(12) United States Patent
Gau et al.

(10) Patent No.: US 6,492,954 B2
(45) Date of Patent: Dec. 10, 2002

(54) MULTI-WAVE-REFLECTOR ANTENNA DISH

(75) Inventors: Jiahn-Rong Gau, Hsinchu; Tzung-Fang Huang, Chiai, both of (TW)

(73) Assignee: Acer Neweb Corporation (TW)

( * ) Notice: Subject to any disclaimer, the term of this patent is extended or adjusted under 35 U.S.C. 154(b) by 0 days.

(21) Appl. No.: 09/797,936

(22) Filed: Mar. 5, 2001

(65) Prior Publication Data

US 2001/0045910 A1 Nov. 29, 2001

(30) Foreign Application Priority Data

May 24, 2000 (TW) ..... 089109978

(51) Int. Cl.[7] ..... H01Q 13/00
(52) U.S. Cl. ..... 343/776; 343/840; 343/779
(58) Field of Search ..... 343/776, 840, 343/912, 914, 781 R, 781 P, 779

(56) References Cited

U.S. PATENT DOCUMENTS 3,680,143 A * 7/1972 Ajioka et al. ..... 343/778
4,757,323 A * 7/1988 Duret et al. ..... 343/756
6,219,003 B1 * 4/2001 Chandler ..... 343/779
6,243,048 B1 * 6/2001 Luh ..... 343/781 P

* cited by examiner

*Primary Examiner*—Tan Ho
(74) *Attorney, Agent, or Firm*—Michael D. Bednarek; Shaw Pittman LLP

(57) ABSTRACT

A multi-wave-reflector antenna dish simultaneously receives signals from different satellites. The antenna dish comprises a reflector with a superquadric projected aperture and a plurality of LNBF modules. The reflector is formed through process including, projecting the superquadric on the paraboloid, projected aperture cutting and surface distortion of the aperture based on the generalized diffraction synthesis technique. In addition to reflecting signals from satellites, it also generates focusing waves sharing similar radiation patterns and horizontal gain with incoming waves on the focal plane, finally to be received by the LNBF modules.

16 Claims, 6 Drawing Sheets

MULTI-WAVE-REFLECTOR ANTENNA DISH

REFERENCE TO RELATED APPLICATIONS

The present application claims priority to Taiwan application No. 089109978 entitled "Multi-wave-reflector antenna dish" filed on May 24, 2000.

BACKGROUND OF THE INVENTION

1. Field of the Invention

The present invention relates to the structure of an antenna dish and more particularly to a multi-wave-reflector antenna dish, which has a minimal dish surface and simultaneously receives signals from a plurality of satellites, at fixed angles from each other; and related manufacturing techniques.

2. Description of the Related Art

In general, based on the fact that a direct broadcast satellite (DBS) is a point-to-multipoint, a ground receiver is capable of receiving signals directly from synchronized satellites by means of a small receiving antenna, a tuner device and household equipment. The process of transmission via satellite is as shown in FIG. 1, wherein program signals, digital audio as well as video, are transmitted with precision to an orbiting synchronized satellite 15 by manipulating an up-link antenna dish (transmitting antenna) 10. After individual users receive downlink signals transmitted by the satellite 15 through the antenna dish 20 and select desired satellite programs using a panel control on the satellite TV receiver 25, video and stereo audio signals are separated and played on the TV set 30.

FIG. 2 shows each component of the antenna dish 40 for receiving satellite signals with precision. The receiving antenna dish 40 comprises a parabolic reflector 42 for receiving and having satellite signals concentrated on the focal point. In addition, a LNBF (low noise block with integrated feed) module is installed on the parabolic reflector 42 to convert incoming radio frequency signals into intermediate frequency signals and send said signals to the tuner. Waves parallel to the axis of the parabolic reflector 42 are reflected by the reflector and concentrated on the focal point where the LNBF module 44 is positioned. Note that LNBF module 44 comprises a waveguide antenna 46 to receive microwave signals on the front end thereof and a circuit system 48 to process the signals on the rear end thereof. Furthermore, in addition to noise filtering, the LNBF module 44 also amplifies received signals from the parabolic reflector 42 to an acceptable scale for processing.

It should be noted that the conventional antenna dish 40 as shown in FIG. 2 is a circular parabolic antenna. Accordingly the equation of the aperture thereof can be expressed as $X^2+Y^2=4fz$, wherein f refers to the focal length of the circular dish.

Provided that the LNBF module is positioned at the only focal point of the circular dish and the reflector is orientated to the desired satellite, the said antenna is ready for reception and demodulation of the signals. As a result of the strong concentrating character of the focal point on the circular dish, the LNBF module 44 on the focal point receives signals with extremely high S/N (signal to noise) ratio. This significantly enhances reception. In other words, in conventional antenna designs, the strong concentrating character of the focal point on the circular dish contributes to gain raise, lower spillover loss and a better quality of received signal.

On the other hand, it is also the same strong concentrating character at the focal point on the circular dish that suppresses gain from unfocused waves and generates a considerably lower gain than it does from the axis of the circular dish. Therefore, when LNBF module 44 positioned at a non-focal point on the focal plane, the received S/N ratio is noticeably lower than that when LNBF module 44 is positioned at the focal point. In other words, a circular antenna dish can only receive signals from a targeted satellite and is not capable of receiving signals from other satellites. If one wants to receive signals from any other satellites using the same antenna dish, the orientation and the angle of elevation have to be readjusted in order to bring the axis of the paraboloid reflector 42 parallel to signal waves from other satellites, to concentrate the signal waves on LNBF module 44. There are alternatives to receive signals from a plurality of satellites such as installing several antenna dishes, but these alternatives are costly and require a large area.

It is noted that the quantity of communication satellites for transmitting various programs has continued to grow with the rapid development of communication satellite systems. From a user's perspective, the capability to simultaneously receive programs broadcast from several satellites on a single antenna dish saves both cost and space. It is also more convenient and practical for users.

SUMMARY OF THE INVENTION

The objective of the present invention is to provide a multi-wave-reflector antenna dish that simultaneously receives signals from a plurality of satellites, at fixed angles from each other.

Another objective of the present invention is to provide an antenna dish that simultaneously receives signals from a plurality of satellites by integrating a reflector and a plurality of LNBF modules.

One other objective of the present invention is to provide an antenna dish having a reflector with a super ellipse projected aperture. This enables the reflector to raise gain and cut spillover loss at a non-focal point by minimizing the cross area of the antenna.

The present invention provides a multi-wave-reflector antenna dish that simultaneously receives signals from a plurality of satellites at fixed angles from each other and relevant design techniques. The antenna dish comprises a reflector with a superquadric projected aperture and a plurality of LNBF modules. The reflector is formed by projecting a superquadric on the paraboloid, projected aperture cutting and surface distortion of the aperture based on the generalized diffraction synthesis technique. Surface distortion involves required condition values such as radiation pattern, gain, and sidelobe level. Repeat computations are then conducted based on these variables, accordingly, to form a reflector that simultaneously focuses signals from different satellites on the LNBF module with the same radiation pattern and gain.

BRIEF DESCRIPTION OF DRAWINGS

The following detailed description, given by way of an example and not intended to limit the invention to the embodiments described herein, will best be understood in conjunction with the accompanying drawings, in which.

DETAILED DESCRIPTION OF THE INVENTION

The present invention provides a multi-wave-reflector antenna dish that simultaneously receives signals from a plurality of satellites. The reflector is formed by projecting a superquadric on the paraboloid, projected aperture cutting, and followed by a surface distortion analysis based on a generalized diffraction synthesis technique. Lastly, repetitive iterations are conducted until the result satisfies required conditions such as radiation pattern, gain, sidelobe level etc. such that the function of receiving signals from different satellites is served. A detailed description of the present invention follows.

Figure 1:
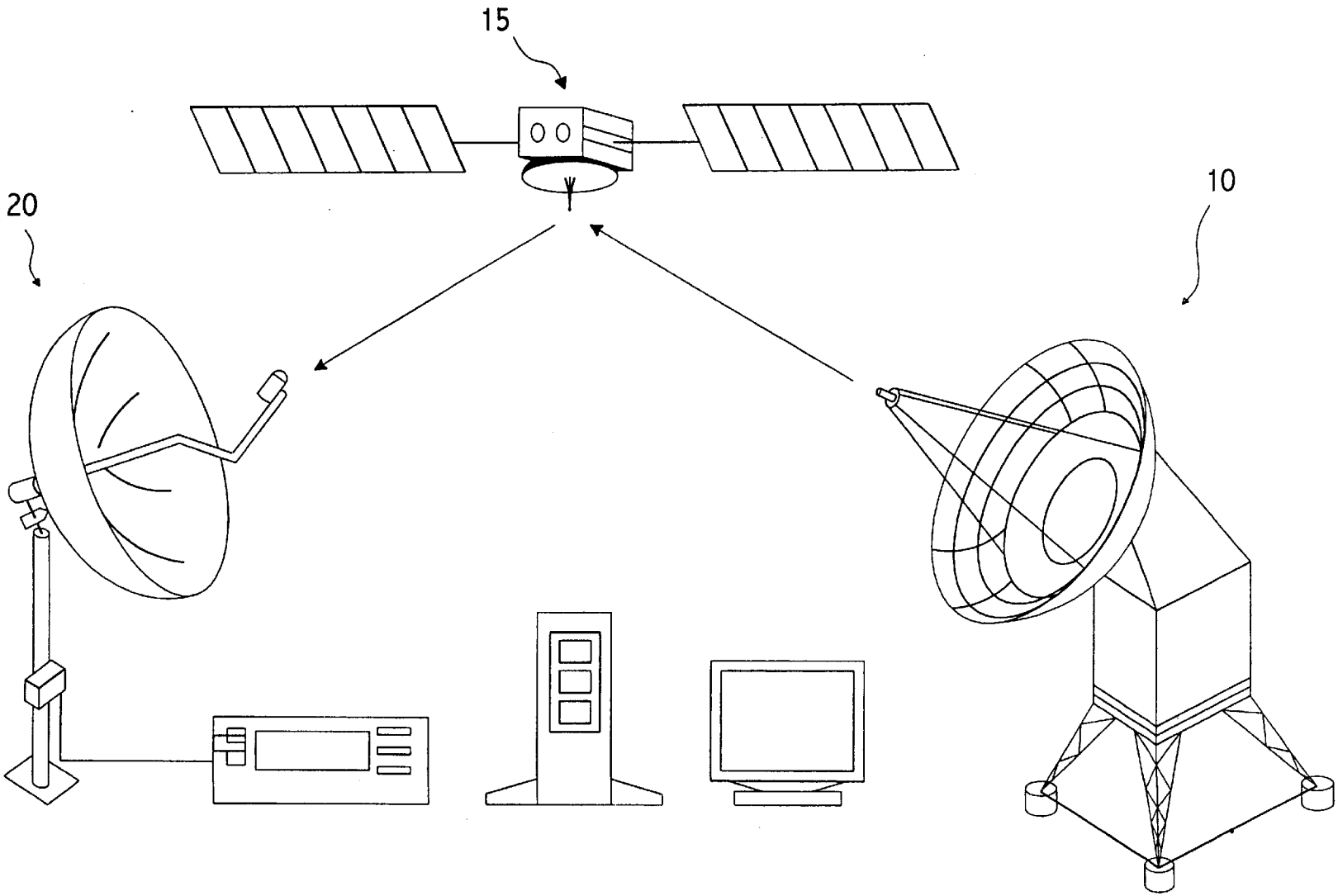
FIG. 1 is an overview of a satellite communication system, wherein an up-link antenna dish transmitting signals to a synchronized satellite and a down-link antenna dish receiving signals are shown.
Figure 2:
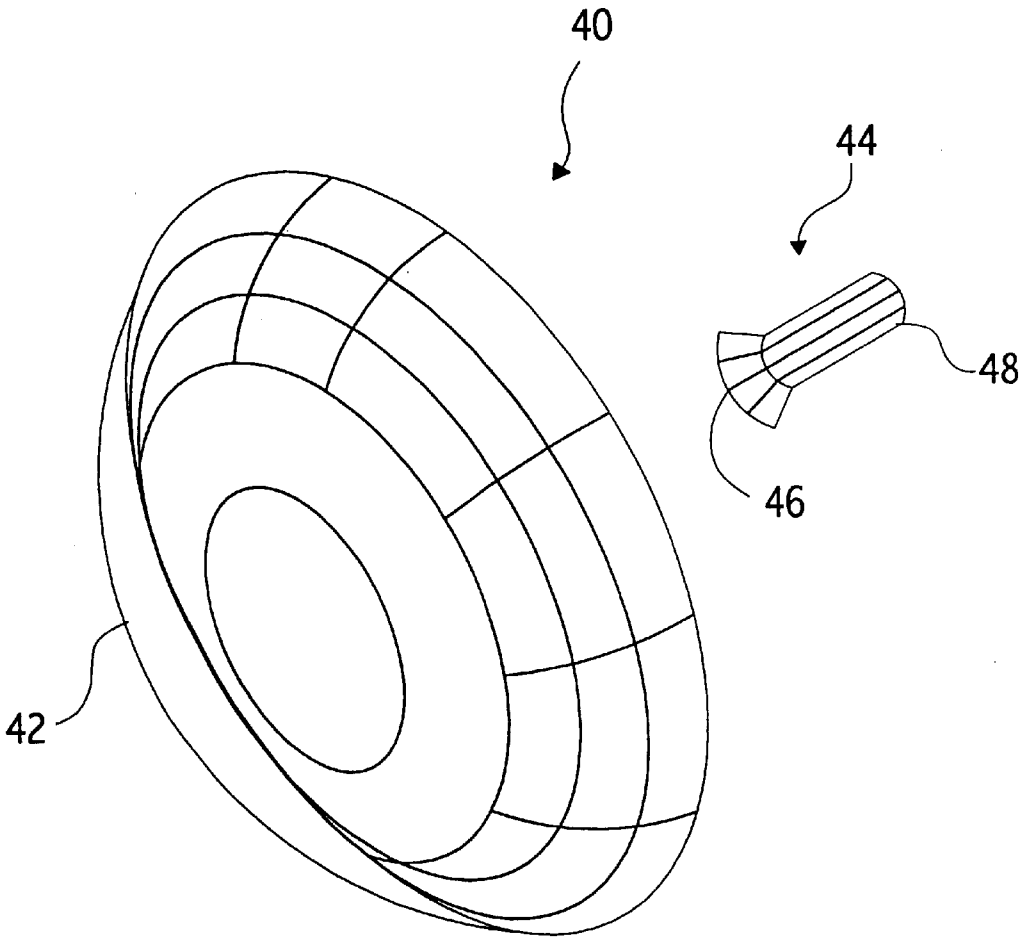
FIG. 2 ( prior art )
FIG. 2 is a side elevational view of the circular antenna dish, wherein an antenna dish with a circular reflector currently widely employed is shown.
Figure 3:
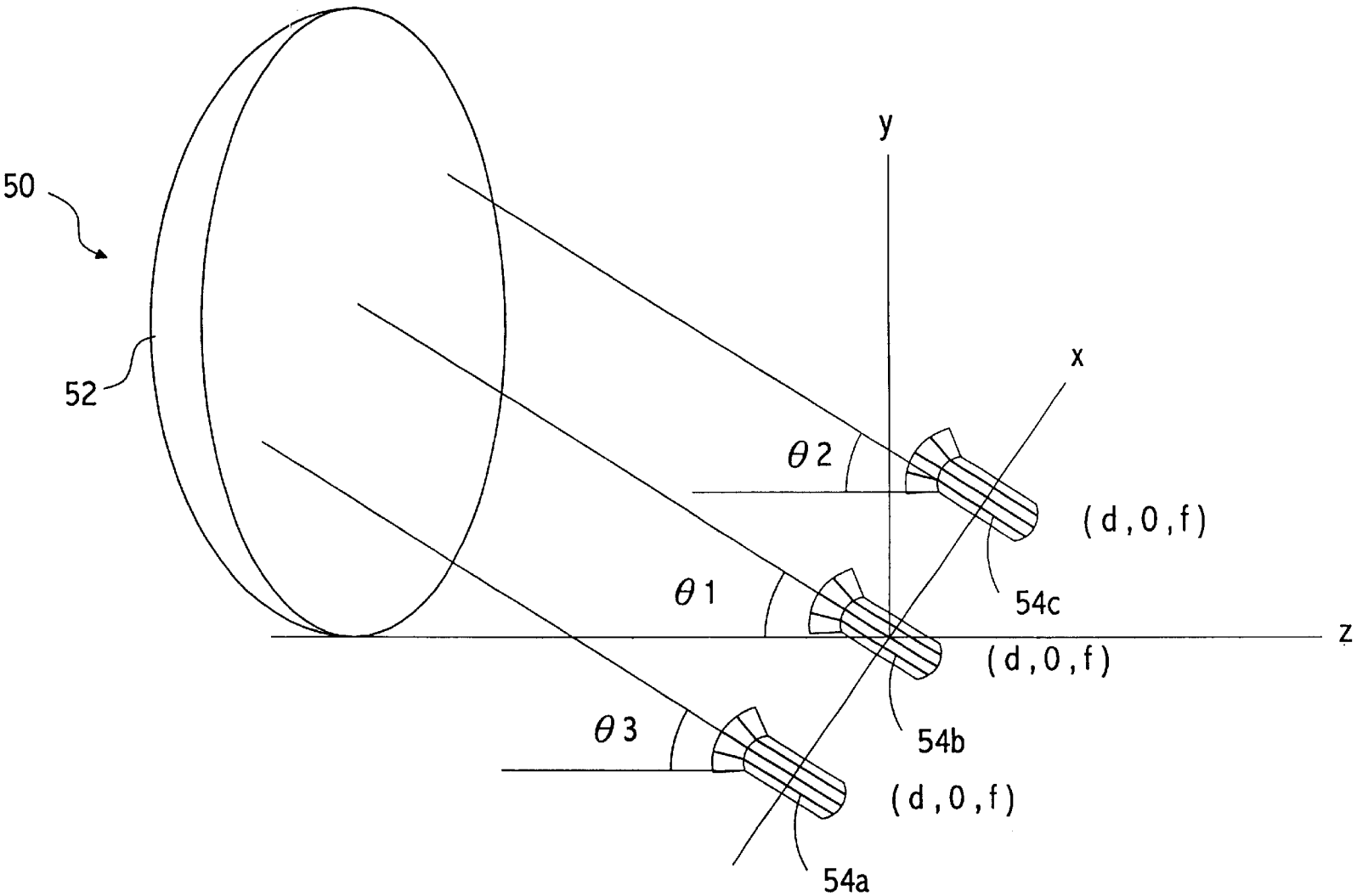
FIG. 3 is a side elevational view of the multi-wave-reflector antenna dish, wherein an antenna dish having a reflector with a super ellipse projected aperture in accordance with the present invention is shown.
Figure 4:
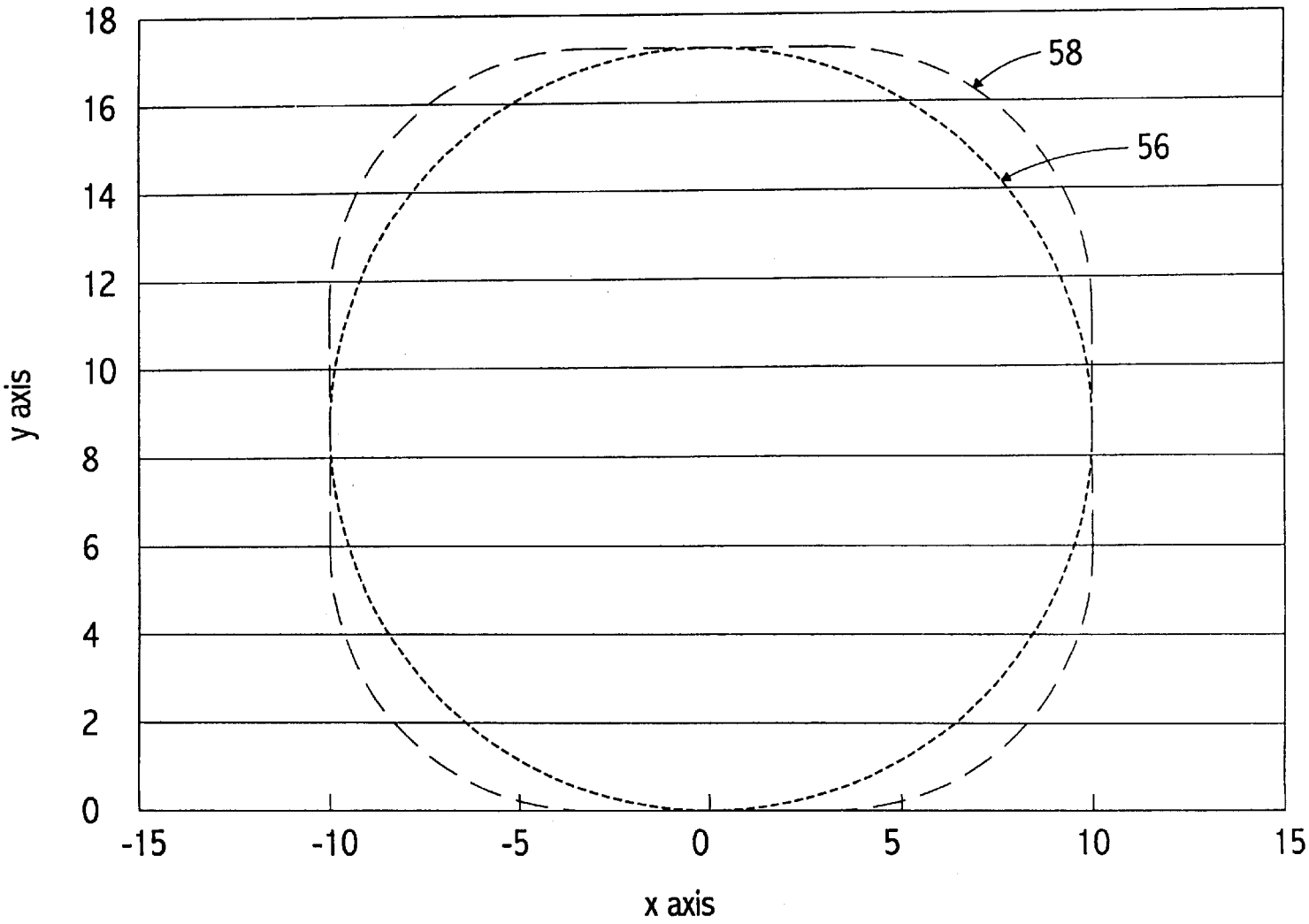
FIG. 4 is a super ellipse plan, wherein the distinction between a super ellipse and an ellipse is shown.

Reference is made to FIG. 3, wherein multi-wave-reflector antenna dish 50 receives signals simultaneously from a plurality of satellites, in accordance with the present invention. The antenna dish comprises a reflector 52 with a super ellipse projected aperture and a plurality of LNBF modules 54*a*~54*c* positioned on the focal plane of the reflector. It should be pointed out that the present example of a super elliptic reflector is employed to increase gain and S/N ratio of the received signal, thereby improving reception efficiency. Reference is now made to FIG. 4, which shows the differences between a super ellipse and an ellipse. Ellipse 56 satisfies the equation $[x/11.25]^n+[(y-8.78)/8.75]^n=1$, with n=2. For n>2, we have a super ellipse. For example, the super ellipse 58 in FIG. 4 is formed when n=3 in the above equation.

Reference is again made to FIG. 3, wherein reflector 52 reflects signal waves from different satellites and generates focused waves respectively on the focal plane to be received by three LNBF modules 54*a*~54*c*. As shown, 54*b* is positioned at (0,0,f), at f distance from the lower edge of the reflector 52, forming an angle θ1 to the xz plane; 54*a* is positioned at (−d,0,f left of 54*b* forming an angle θ2 to the xz plane; and similarly 54*c* is positioned at (d,0,f right of 54*b* forming an angle θ3 to the xz plane. In the preferred embodiment of the invention, the three LNBF modules are arranged in a line, at a distance of 2.6 inches from the dish center on the focal plane of said paraboloid, with a distance f of 12 inches. Elevation angles θ1~θ3 range from 35.73–43.2 degrees. It should be noted that based on tests results, waves focused by the reflector 52 all have the same radiation pattern, gain higher than 34.0 dB, sidelobe levels lower than −25 dB, and a gain differential between them of less than 3%. In other words, each wave is focused effectively on each corresponding LNBF module on the reflector 52.

Figure 5:
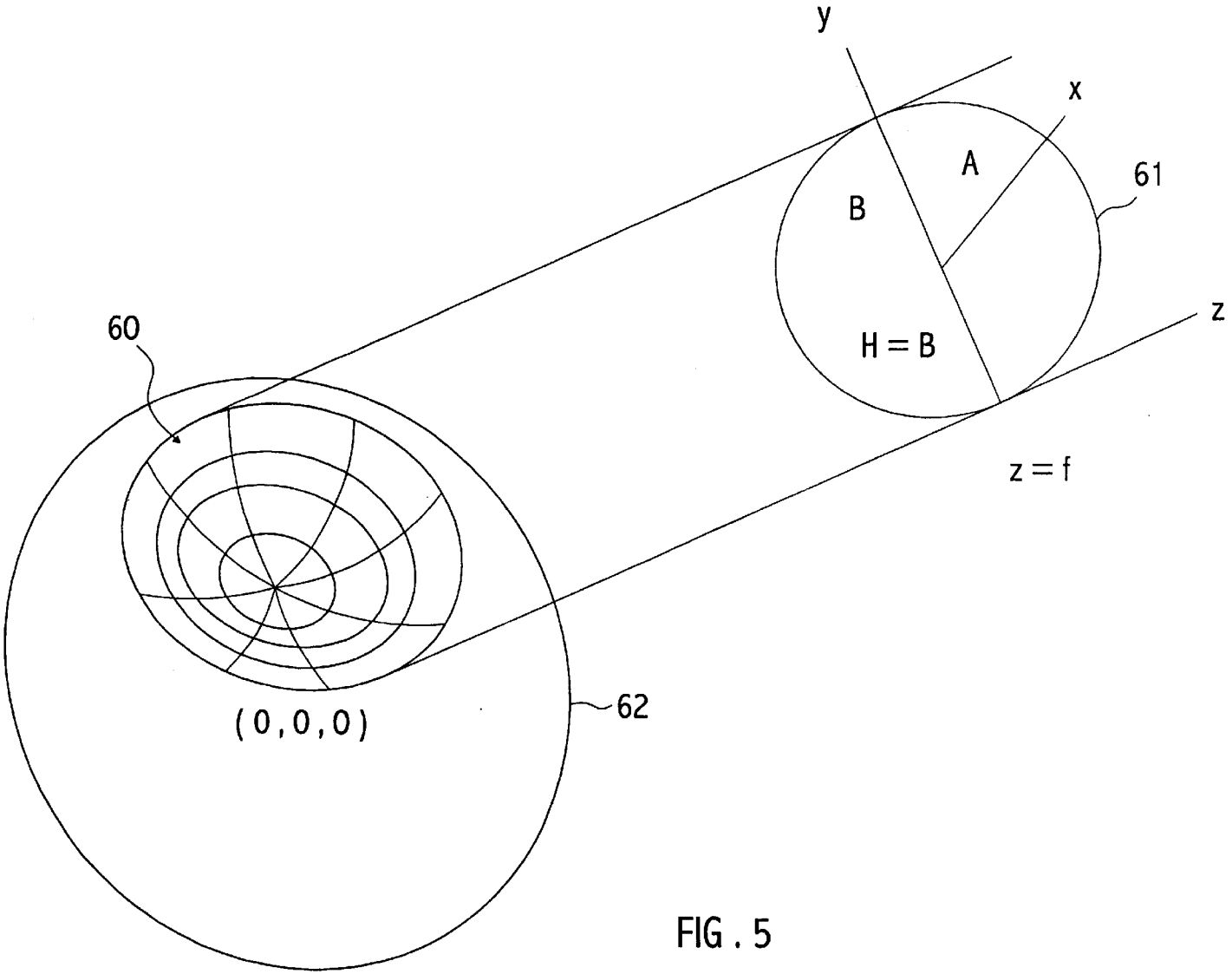
FIG. 5 is a side elevational view of the antenna dish, wherein the process for projection of the super ellipse on a paraboloid, in accordance with the present invention is shown.

In order to enhance the reception of the reflector 52 and efficiently focus the satellite signals as described previously, the reflector 52 with a super ellipse projected aperture is formed through surface distortion. The shape of the reflector is gained from projection of a super ellipse. Consequently, as shown in FIG. 5, the process to produce the shape of the reflector 52 involves first defining superquadric 61 on the plane where z=f, wherein the superquadric 61 then maps on paraboloid 62 and produces a super ellipse projected aperture 60 that satisfies the following equation:

$$[x/A]^n+[(y-B)/B]^n=1,$$

Wherein, A is the horizontal radius of the superquadric 61, B is the vertical radius of the superquadric 61 and n is a control variable to determine the shape of the superquadric 61. H is the distance between the center of the super ellipse projected aperture 60 and the central axis (that is, z-axis in the Figure) of the paraboloid 62. Since the coordinate of the superquadric 61 center is (0,H,f) located on the y-axis, the vertical radius B is equal to the distance H. In the preferred embodiment of the invention, the superquadric 61 that corresponds to the reflector 52 with a super ellipse projected aperture has a horizontal radius A=11.25 inches, a vertical radius B=8.57 inches, n=2.1 and f=12 inches.

Furthermore, a surface distortion based on the generalized diffraction synthesis (GDS) technique is essential, as this shapes the desired reflector aperture. This enables the efficient reflection and focus of satellite signals from different satellites by the reflector 52 with a super ellipse projected aperture, generates focused waves with sufficient gain and keeps the S/N ratio as well as the sidelobe level among incoming waves to a set standard. Based on theories of physical optics, expansion coefficients can be obtained by the basis expansion of the superquadric and following integrations. Moreover, these coefficients can be used to deduct corresponding radiation patterns, peak angles, gains, sidelobe level etc., which are verified to meet standard conditional values. If the result is satisfactory, it indicates the termination of the iteration procedure. If it does not meet the standard conditional values, condition values have to be reset and the synthesis technique then repeated until the result is satisfactory. The numbers of repetitions can also be used as a criterion to decide the termination of the iteration process. For example, the termination can be set at 1000 repetitions.

Figure 6:
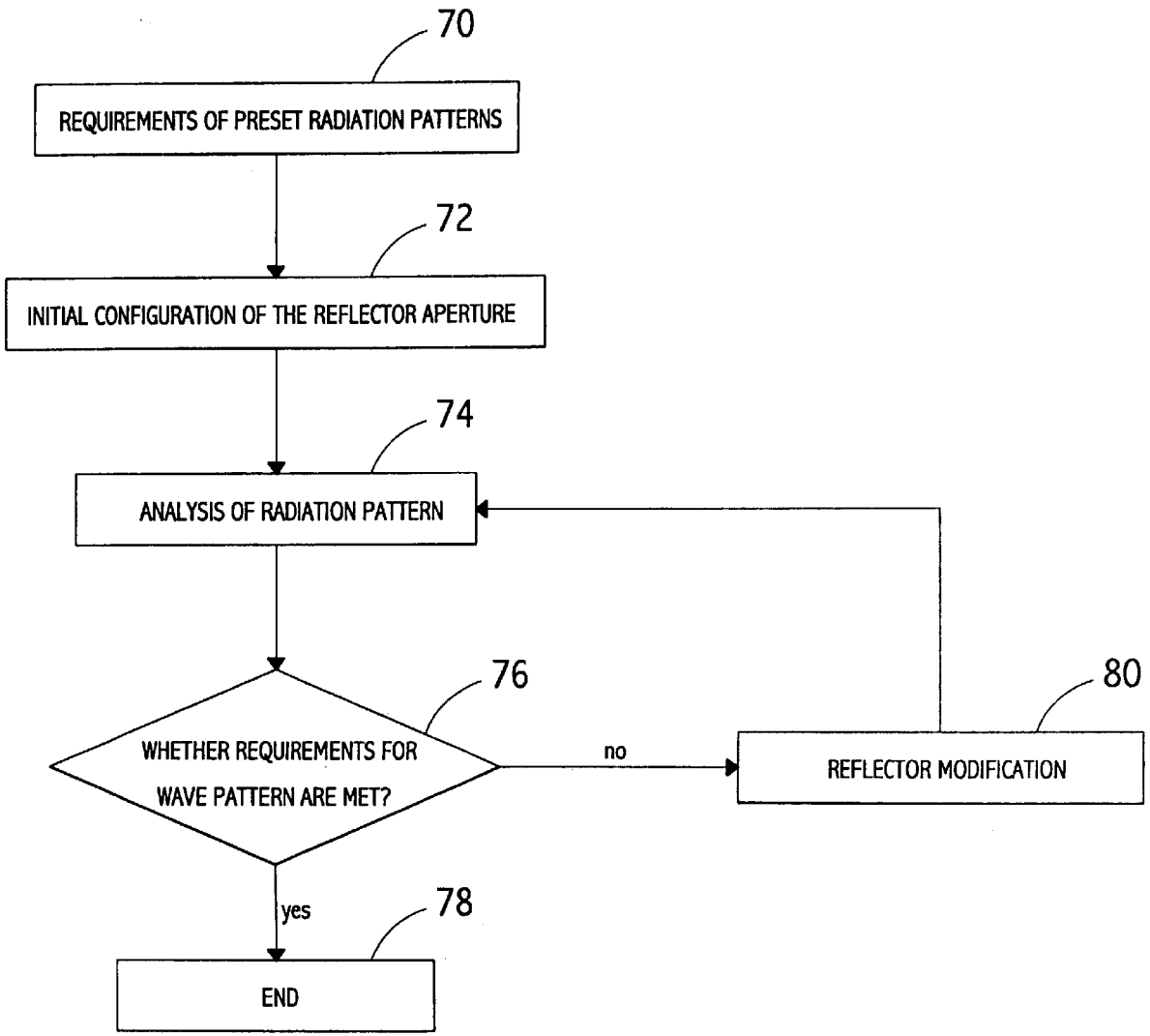
FIG. 6 is a flow chart of the surface distortion on the reflector, wherein detailed procedures regarding effective surface distortion on the reflector with super ellipse projected aperture by the generalized diffraction synthesis technique, in accordance with the present invention, are shown.

FIG. 6 shows the main process of designing the reflector 52 with a super ellipse projected aperture based on the GDS technique. Step 70 deals with the requirements of preset radiation patterns and step 72 deals with the initial configuration of the reflector shape. In general, conditional values applied for the preset radiation pattern are subject to desired conditions. For example, where it is expected to receive signals simultaneously from satellites positioned within a range of 18 degrees longitude (w101, w110, w119), and a preset peak spacing of 10 degrees; consequently, the position of three angles can be described as 0 degrees, 10 degrees and −10 degrees. The radiation pattern can then be decided by setting the gain of each angle.

In addition, a radiation pattern can be determined by desired specifications, for example. When the required conditions are set an incoming wave gain has to be higher than 34 dB and the sidelobe level lower than −25 dB. Alternatively, angles can be applied that correspond to desired satellites, or other possibilities, such as radiation patterns required by the FCC (Federal Communication Commission). This indicates that when $|\theta-\theta_peak|>4|$, the radiation pattern P $\theta<29-25*\log(|\theta-\theta_peak|)$ can be regarded as a required condition, wherein θ is the angle to the xy plane and θ_peak is the angle at wave peak.

Other than taking limiting conditions related to radiation pattern into consideration, limiting conditions related to components that are responsible for satellites signals reception can also be one of the limiting conditions. For example, one can firstly find the angle θ between the central axis of waveguide on the LNBF module and its position and then describe the radiation pattern by a cosine function with θ as a required initial condition. For example, in the preferred embodiment of the invention, [cos(θ)]^5.3 is used to describe the feed pattern of the LNBF module.

Following that, as described in step 72, a set of data is used to determine the shape of the reflector. In the preferred embodiment of the invention, by means of projecting a superquadric on the paraboloid, projected aperture cutting, the desired aperture of the reflector is formed to raise gain. However, in the reality, the initial shape for projected aperture cutting may vary between a circle, an ellipse or a super ellipse, based on desired effects. The analysis of radiation pattern as indicated in step 74 is carried out using the GDS technique. In general, when basis expansion proceeds, it can lead to a global surface expansion of; $Zm=\Sigma\Sigma[Cnm*\cos(n\phi)+Dnm*\sin(n\phi)]*Fnm(t)$, where Σ represents the summation of values from n to m, Zm is the z coordinates value. Moreover, as shown in FIG. 4 a super ellipse is projected on a paraboloid 62 to form the desired aperture. As a result, a set of initial base plane coefficients can be obtained by taking the basis expansion of the paraboloid equation.

Due to the fact that the superquadric 61 is a super ellipse, one may apply conditional values from the reflector 52 with a super ellipse projected aperture. For example, as data indicated in FIG. 4 we can substitute the values of horizontal radius A, vertical radius B, focal length f, and distance from the center to z-axis in the equation. The FID ratio (focal length to diameter length ratio) of reception antennas in the United States is approximately less than 0.6. When the reflector shape is determined as a super ellipse we can set a horizontal radius A=11.25 inches, vertical radius B=H=8.57 inches, focal length f=10 inches. Based on the aforementioned initial expansion coefficients, set up values and radiation pattern, a set of output expansion coefficients can be obtained.

In the following step 76, output expansion coefficients, corresponding radiation pattern and other related values have to be verified to assure wave pattern requirements are satisfied. If the result meets these requirements, this indicates the termination of the iteration procedure in step 78. If it does not meet said requirements, then as in step 80, the reflector has to be readjusted and the analysis of radiation pattern in step 74 repeated until the requirements are met. Normally, readjusting the reflector's symmetry coefficients leads to a satisfying corresponding radiation pattern. Alternatively, one can replace the initial expansion coefficients with the output expansion coefficients obtained before the symmetry coefficients are adjusted and then repeat the radiation pattern analysis in step 74. Apart from replacing the initial expansion coefficients with the output expansion coefficients, it is also recommended that conditional values are reset, repeating the radiation pattern analysis. It is noted that during the application of the aforementioned synthesis technique, the steepest decent method (SDM) can be applied to accelerate convergence.

As mentioned above, in one embodiment of the invention, the reflector antenna dish simultaneously receives signals transmitted from three satellites positioned within a range of 18 degrees longitude (w101, w110, w119), in which a peak spacing of about 10 degrees is required. In reality, when applied to antenna dishes in the United States, peak spacing frequently ranges from 9.62 degrees to 10.36 degrees, due to different reception locations. In addition, the reflector is formed by projected aperture cutting of the paraboloid as shown in FIG. 4, therefore the initial expansion coefficients can be obtained by taking the basis expansion of the paraboloid equation. If n=m=6 and the value of Cnm and Dnm is set at 0, then C00=−6.666739, C01=−0.4252744, D10=1.530102, C20=0.2258872. Based on past experience, when the elevation angle of three LNBF modules 54*a*~*c* and θ1, θ2, θ3 on the xz plane is set as 37.63 degrees; and three LNBF modules are positioned at (−2.47 inches,0,f), (0,0,f), (2.47 inches,0,f respectively, that means the LNBF modules 54*a*~*c* are positioned exactly on the focal plane of the aperture 62 and that the LNBF module 54*b*, located in the middle of the three modules, is right at the focal point of the paraboloid.

This is followed by setting the radiation pattern condition as follows: center beam at 0 degrees as 28.5 dB, −5.5 degrees as 0 dB and 5.5 degrees as 0 dB; while, left beam at −10.05 degrees as 33.5 dB, −4.8 degrees as 0 dB and −15.7 degrees as 0 dB; right beam at 10.05 degrees as 33.5 dB, 4.8 degrees as 0 dB and 15.7 degrees as 0 dB. At 1,000 repetition of the iteration process, the preliminary result is: center beam—gain is about 34.54217 dB, peak angle is 0 degrees and sidelobe level is −24.69 dB; left beam—gain is about 34.19574 dB, peak angle is −9.9 degrees, sidelobe level is −23.59 dB; right beam—gain is about 34.19833 dB, peak angle is 9.9 degrees, sidelobe level is −23.46 dB.

From the data above, none of the sidelobe values meet the necessary requirements, therefore corresponding angles need to be reset so that radiation pattern values can be lowered. In other words, the peak angle and peak intensity values from the previous data can be applied as conditional values in the following calculation. Also, the radiation intensity of the angles applied can be set as 0 in order to receive lower radiation pattern values and conditional variables can be increased to 5. Accordingly, radiation pattern conditions are readjusted as: center beam at 0 degrees as 34.54217 dB, at −5 degrees, −6 degrees, 5 degrees, 6 degrees all as 0 dB; left beam at −9.9 degrees as 34.19574 dB, at −15 degrees, −16 degrees, −16.5 degrees, −17 degrees all as 0 dB; right beam at 9.9 degrees as 34.19833 dB, 5 degrees, 16 degrees, 16.5 degrees, 17 degrees all as 0dB. At 1,000 repetitions of the iteration process, the result is, center beam: gain is about 34.54937dB, peak angle is 0 degrees and sidelobe level is −26.37dB; left beam:

gain is about 34.18287 dB, peak angle is −9.9 degrees, sidelobe level is −24.75 dB; right beam, gain is about 34.19072 dB, peak angle is9.9 degrees, sidelobe level is −24.48 dB.

As with the first trial, the sidelobe values of the modules at either side do not meet requirements, therefore related angles need to be further readjusted so that the corresponding radiation pattern values can be lowered. Accordingly, radiation pattern conditions are readjusted to: center beam at 0 degrees as 34.54937 dB, at −5 degrees, −6 degrees, 5 degrees, 6 degrees all as 0 dB; left beam at −9.9 degrees as 34.19574 dB, at −15 degrees, −16 degrees, −16.5 degrees, −17 degrees all as 0 dB; right beam at 9.9 degrees as 34.19072 dB, 5 degrees, 16 degrees, 16.5 degrees, 17 degrees all as 0 dB. At 1,000 repetitions of the iteration process, the result is, center beam: gain is about 34.55395 dB, peak angle is 0 degrees and sidelobe level is −26.38 dB; left beam: gain is about 34.18287 dB, peak angle is −9.9 degrees, sidelobe level is −25.30 dB; right beam, gain is about 34.16692 dB, peak angle is 9.9 degrees, sidelobe level is −24.32 dB.

The sidelobe level of the right beam remains unsatisfactory. As a result, the angles are reset, concentrating on the range 15.5–17.5 degrees, to lower the corresponding radiation pattern values. Other than substituting the peak angle and peak intensity values from the previous data in the following calculation, required condition variables can also be increased to 7. Accordingly, radiation pattern conditions are readjusted as: center beam at 0 degrees as 34.55395 dB, at −5 degrees, −6 degrees, −7 degrees, 5 degrees, 6 degrees, 7 degrees all as 0 dB; left beam at −9.9 degrees as 34.16967 dB, at −5 degrees, −6 degrees, −15 degrees, −16 degrees, −16.5 degrees, −17 degrees all as 0 dB; right beam at 9.9 degrees as 34.16692 dB, 3.5 degrees, 4.5 degrees, 15.5 degrees, 16.5 degrees, 16.5 degrees, 17 degrees all as 0 dB.

It should be noted that setting right beams at 16.5 degrees as 0 dB, is repeated twice. At 1,000 repetitions of the iteration process, the result for the center beam is: gain is about 34.55002 dB, peak angle is 0 degrees and sidelobe level is −26.95 dB; left beam: gain is about 34.15734 dB, peak angle is −9.9 degrees, sidelobe level is −25.50 dB; right beam, gain is about 34.16191 dB, peak angle is 9.9 degrees, sidelobe level is −24.70 dB. Nonetheless, the sidelobe level of the right beam is unsatisfactory. It is to be noted that the significant digits of the computation are often a source of errors. Thus an attempt is made to find absolute values from the values of Cnm and Dnm (n=0~6, m=0~6) with the same m and n and fix the smaller value as zero.

The final procedure gives the multi-wave-reflector antenna dish a symmetric shape, resulting data is as follows: center beam: gain is about 34.55985 dB, peak angle is 0 degrees and sidelobe level is −27.10 dB; left beam: gain is about 34.16049 dB, peak angle is −9.9 degrees, sidelobe level is −25.10 dB; right beam: gain is about 34.16094 dB, peak angle is 9.9 degrees, sidelobe level is −25.10 dB. In a real trial wherein incoming wave frequency is 12.45 GHz, feed spacing is 2.47 inches and feeding elevation angle is 37.63 degrees, it is found that, the requirements for designing condition values such as gain, peak dividing, sidelobe level are met, in accordance with the data obtained by the above synthesis technique. For that reason, the surface of the multi-wave-reflector antenna dish is obtained and the design process can be terminated.

This invention provides many advantages. For example, in the said embodiment of the invention, by adjusting the surface distortion, the obtained reflector antenna dish is capable of receiving signals from three satellites positioned at longitude (w101, w110, w119). It receives incoming signals within a range of 18 degrees longitude, furthermore, it effectively focuses three incoming waves from satellites on the three LNBF modules and generates similar radiation pattern, horizontal gain and sidelobe level. In particular, with the way in which the invention is designed, one can design an antenna dish that receives signals from several satellites as required (such as the number of satellites or angle of satellites). Because an antenna dish with satisfactory reception efficiency involves only a reflector with a superquadric projected aperture, which can be a super ellipse (n>2) projected aperture or an ellipse (n=2) projected aperture, and several LNBF modules installed on the antenna dish, it results in substantial reductions in the cost of satellite reception.

As mentioned above, the synthesis technique used to shape the paraboloid by surface distortion when designing the reflector provides the advantage of shaping a reflector that satisfies desired signal reception requirements and thus allows different reception results by adjusting condition values. In the preferred embodiment of the invention, via process as projecting superquadric on the paraboloid, projected aperture cutting to gain desired aperture and on the premise that the aperture area is not to be enlarged, this successfully raises the S/N ratio and facilitates improved reception of satellite signals.

While the invention has been described with reference to various illustrative embodiments, the description herein should not be construed in a limiting sense. Various modifications of the illustrative embodiments, as well as other embodiments of the invention, will be apparent to those skilled in the art upon reference to this description. It is therefore contemplated that the appended claims will cover any such modifications or embodiments as may fall within the scope of the invention defined by the following claims and their equivalents.

What is claimed is:

1. A multi-wave-reflector antenna dish, comprising:

a reflector with a projected aperture, a minimal dish surface, simultaneously receiving signals from a plurality of satellites at fixed angles from each other, and producing a plurality of corresponding focusing waves sharing approximate radiation fields and having properties meeting requirements for satellite communication reception; and a plurality of LNBF modules positioned on the focal plane of the said reflector to receive said focusing waves, wherein a cutting boundary of superquadric used for the projected aperture satisfies an equation, $[X/A]^n+[(Y-B)/B]^n=1$, where A is the mapping horizontal radius of the superquadric aperture onto the XY plane, B is the mapping vertical radius of the superquadric aperture onto the XY plane, and n the coefficient of the equation with range from 2 to 3.

2. An antenna dish of claim 1, wherein said reflector with the projected aperture is formed from projected aperture cutting on a paraboloid that satisfies an equation of $X^2+Y^2=4fz$ with focus f.

3. An antenna dish of claim 2, wherein the said plurality of LNBF modules, have angles of elevation ranging from 35.73 to 43.2 degrees and are arranged in a line within a distance of 2.6 inches from the dish center on the focal plane of said paraboloid with an f of 12 inches.

4. An antenna dish of claim 2, wherein said reflector with the superquadric projected aperture is formed by process including, projecting said superquadric on the paraboloid, projected aperture cutting and surface distortion of the aperture.

5. An antenna dish of claim 4, further including the generalized diffraction synthesis technique to complete said surface distortion.

6. An antenna dish of claim 1, wherein said superquadric is an ellipse when n=2.

7. An antenna dish of claim 1, wherein said superquadric is a super ellipse when n>2.

8. An antenna dish of claim 1, wherein said requirements for satellite communication reception include (a) each focusing wave has gain higher than 34.0 dB and a sidelobe level lower than −25 dB, and (b) gain differential between the focusing waves is less than 3%.

9. An antenna dish of claim 1, wherein said requirements for satellite communication reception are met when said superquadric is with an n=2.1, the mapping horizontal radius onto XY plane is 11.25 inches and the mapping vertical radius onto XY plane is 8.75 inches.

10. An antenna dish of claim 9, wherein the said antenna dish simultaneously receives signals transmitted from three satellites positioned within a range of 18 degrees longitude (w101 w110, w119).

11. A shaping method for an antenna dish having a reflector with a projected aperture wherein a cutting boundary of superquadric used for the projected aperture satisfies an equation, $[X/A]^n+[(Y-B)/B]^n=1$, where A is the mapping horizontal radius of the said superquadric aperture onto the XY plane, B is the mapping vertical radius of the superquadric aperture onto the XY plane, and n the coefficient of the equation with range from 2 to 3, employed for receiving signals from at least three satellites; and under the condition of a minimal dish area, simultaneously receiving signals transmitted from satellites positioned within a certain range of angles thus producing a plurality of focusing waves respectively with properties that meet the requirements for satellite communication reception, comprising the steps:

(1) setting up requirements for radiation pattern;

(2) setting up initial configuration of the reflector shape;

(3) analyzing a radiation pattern;

(4) verifying whether pattern requirements established in step (1) are met; and (5) if not, adjusting aperture coefficients and repeating step (4).

12. A shaping method for an antenna dish of claim 11, wherein said reflector with the projected aperture is formed from a projected aperture cutting on a paraboloid that satisfies an equation of $X^2+Y^2=4fz$ with focus f.

13. A construction method for an antenna dish of claim 12, wherein the initial configuration for the reflector shape in step (2) is a plurality of LNBF modules, with angles of elevation ranging from 35.73 to 43.2 degrees, arranged in a line, within a distance of 2.6 inches from the dish center on the focal plane of said paraboloid, with an f of 12 inches.

14. A shaping method for an antenna dish of claim 11, wherein the requirements of radiation pattern in step (1) include (a) each focusing wave has gain higher than 34.0 dB and a sidelobe level lower than −25 dB, and (b) gain differential between the focusing waves is less than 3%.

15. A construction method for an antenna dish of claim 11, wherein the n of the said equation is 2.1, the horizontal radius mapped onto XY plane is 11.25 inches and the vertical radius mapped onto XY plane is 8.75 inches.

16. A construction method for an antenna dish of claim 15, wherein said antenna dish simultaneously receives signals transmitted from three satellites positioned within a range of 18 degrees longitude (w101 w110, w119).

* * * * *

UNITED STATES PATENT AND TRADEMARK OFFICE

CERTIFICATE OF CORRECTION

PATENT NO. : 6,492,954 B2
DATED : December 10, 2002
INVENTOR(S) : Gau et al.

It is certified that error appears in the above-identified patent and that said Letters Patent is hereby corrected as shown below:

Drawings,
Figure 3, 54b, "(d, 0, f)" should be -- (0, 0, f) --

Column 5,
Line 23, "the summation of values from n to m" should be -- the summation of values over n and m from 0 to infinity --
Line 34, "the FID ratio" should be -- the F/D ratio --

Signed and Sealed this

Tenth Day of August, 2004

JON W. DUDAS
*Acting Director of the United States Patent and Trademark Office*